US005333768A

United States Patent [19]

Krentz

[11] Patent Number: 5,333,768

[45] Date of Patent: Aug. 2, 1994

[54] ADJUSTABLE CHEST POUCH

[76] Inventor: Douglas J. Krentz, 2827 Coventry Green, Hamburg, N.Y. 14075

[21] Appl. No.: 5,279

[22] Filed: Jan. 19, 1993

[51] Int. Cl.[5] ..... A45F 3/04

[52] U.S. Cl. ..... 224/215; 224/229

[58] Field of Search ..... 224/215, 229, 259, 209

[56] References Cited

U.S. PATENT DOCUMENTS

| | | | |
|---|---|---|---|
| 1,418,371 | 6/1922 | Foster | 224/229 X |
| 2,676,738 | 4/1954 | Herrick | 224/215 |
| 2,688,752 | 9/1954 | Sbarra et al. | 224/215 X |
| 3,089,143 | 5/1963 | Jacobson | 224/259 X |
| 5,116,306 | 5/1992 | Zander | 224/209 X |

FOREIGN PATENT DOCUMENTS

| | | | |
|---|---|---|---|
| 624295 | 7/1981 | Switzerland | 224/229 |

*Primary Examiner*—Renee S. Luebke

*Attorney, Agent, or Firm*—Hodgson, Russ, Andrews, Woods & Goodyear

[57] ABSTRACT

A chest pouch garment (10) that is easily donned to position a chest pouch (12) on a person's chest to hold personal effects, such as a Walkman-type radio (26) and other like personal effects including money and valuables, and medical telemetry equipment. Elastic shoulder straps (18, 20) and chest straps (22 and 24) extend between a back connecting member (16) and the chest pouch. One of the chest straps is releasably attached to the chest pouch by a hook and loop VELCRO fastener to provide for adjusting the length of the one chest strap and consequently the position of the pouch on the chest to a comfortable location. That way, the garment can be worn by people having various chest sizes from grown adults to children.

8 Claims, 2 Drawing Sheets

Fig. 4.
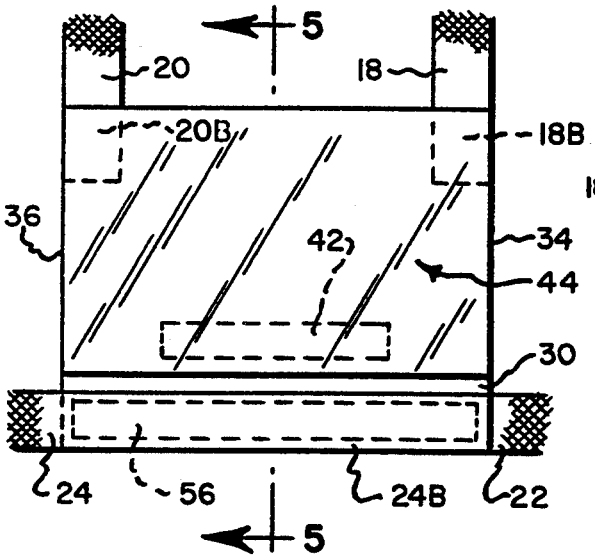
Fig. 7.
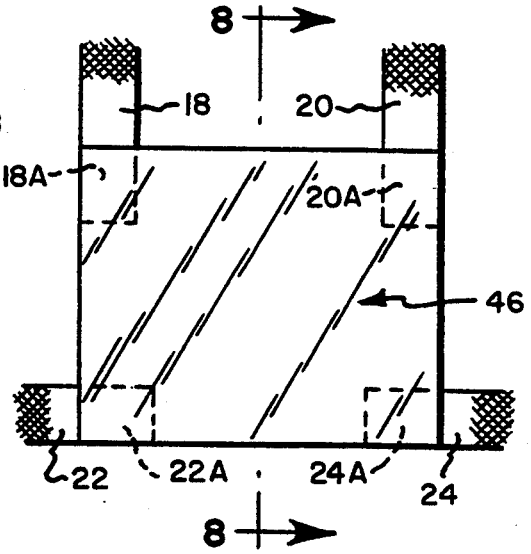
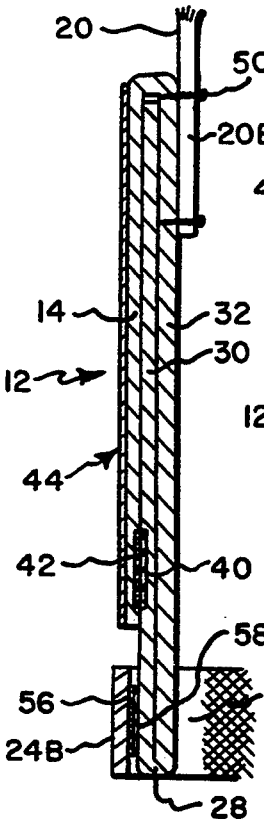
Fig. 5.
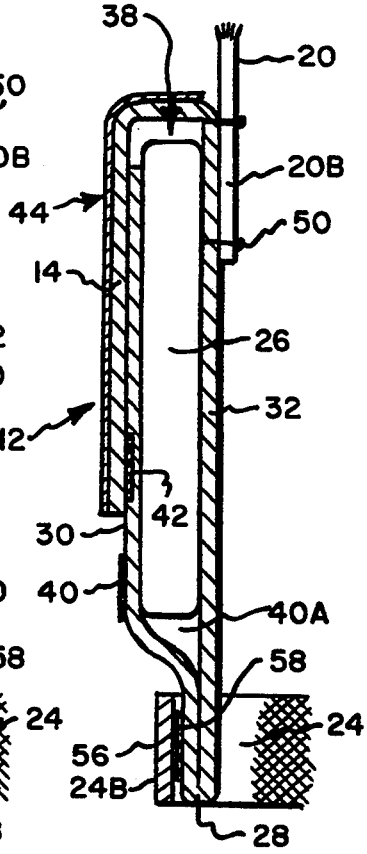
Fig. 6.
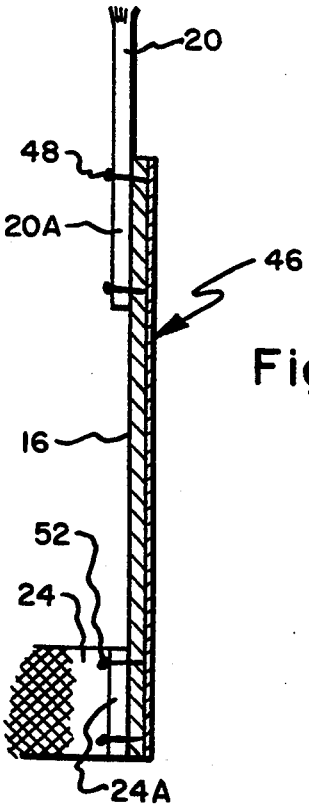
Fig. 8.

ADJUSTABLE CHEST POUCH

BACKGROUND OF THE INVENTION

This invention relates to a bag device and more particularly to a closable pouch worn against the chest as a pouch garment. The pouch garment is easily donned, fits people having various chest sizes and is useful for holding personal effects.

People sometimes desire to listen to the radio or to other forms of recorded music and speech without having to hold the radio in their hand. Also, people often dress in clothes that do not have pockets or other means for holding personal effects, such as keys, money, jewelry, and other valuables. Without a secure place to hold these items, they risk losing them. This is especially the case for people engaged in strenuous activities, such as running and bicycling and the like.

PRIOR ART

The prior art has described a variety of pouch devices that are useful for holding personal effects. Representative of these devices is U.S. Pat. No. 37,785 to Engelhard which describes a money-safe worn against the chest and held in place by a pair of adjustable shoulder straps that cross in the back and connect to the money-safe at a position adjacent the waist. This device does not provide a back connecting member for the straps which can easily become crossed as the money-safe is being donned. It is also difficult to reach the straps to connect them to the money-safe at the waist.

U.S. Pat. No. 4,764,962 to Ekman et al describes a pouch for holding a Walkman-type radio that is worn on the chest by means of a pair of suspender straps that provide for mounting a pair of loudspeakers for the radio. The suspender straps would discourage people wearing knee-length trousers, such as gym shorts, from using this device because the suspenders would tend to pull the shorts into an uncomfortable position. It may otherwise be considered bothersome by many to use suspenders.

U.S. Pat. Nos. 4,125,212; 4,872,599 and 5,016,797 describe a variety of pouch devices. However, these devices are not particularly useful for holding a Walkman-type radio and other personal effects and the like against the chest of a person engaged in recreational activities, particularly where the activity is strenuous.

In accordance with the present invention, there is provided a slip-over chest pouch garment that is easily donned and that fits persons having various chest sizes. The pouch is positioned against the chest and is useful for holding a Walkman-type radio and/or other personal effects. This is especially useful for people engaged in recreational activities, such as running, bicycling, and the like. An adjustable chest strap enables the garment to be worn by people that are of various sizes from children to full-grown adults.

OBJECTS

It is therefore an object of the present invention to provide a chest pouch as a "slip-over" garment that is easily donned.

It is a further object of the present invention to provide a chest pouch garment that is comfortable to wear by people having various chest sizes.

Finally, it is an object of the present invention to provide a chest pouch garment that is inexpensive to manufacture, easy to don and adjustable to comfortably fit people having various chest sizes.

These and other objects, features, and advantages of the present invention will become apparent in the following detailed description of the present embodiment thereof when read in conjunction with the accompanying drawings wherein the same reference numerals denote like or similar parts throughout the several views.

SUMMARY OF THE INVENTION

The pouch of the present invention is a "slip-over" chest pouch garment that is donned by slipping the garment over a person's head with the pouch positioned against the chest and held in place by a pair of shoulder straps that connect between a back connecting member and the pouch, and a pair of chest straps that extend around the torso and under the arms between the back member and the chest pouch. The back connecting member prevents the shoulder straps and chest straps from becoming twisted as the garmet is donned. One of the chest straps is releasably and adjustably attached to the chest pouch to provide for adjusting the length of the one chest strap and therefore the position of the pouch on the chest. This provides a comfortable fit for the chest pouch of the present invention so that it can be worn by persons having various chest sizes. The shoulder straps and chest straps are preferably made of an elastomeric material that further helps to adjust the fit of the chest pouch. A front flap closes the pouch and ensures that the personal effects held inside the pouch will not fall out.

IN THE DRAWINGS

FIG. 4 is a front partial elevational view thereof.

FIG. 5 is a cross-sectional view thereof taken along lines 5—5 of FIG. 4 with chest pouch 12 empty.

FIG. 6 is a cross-sectional view similar to that of FIG. 5 with chest pouch 12 holding radio 26.

FIG. 7 is a partial rear elevational view thereof.

FIG. 8 is a cross-sectional view thereof taken along lines 8—8 of FIG. 7.

DETAILED DESCRIPTION

Figure 1:
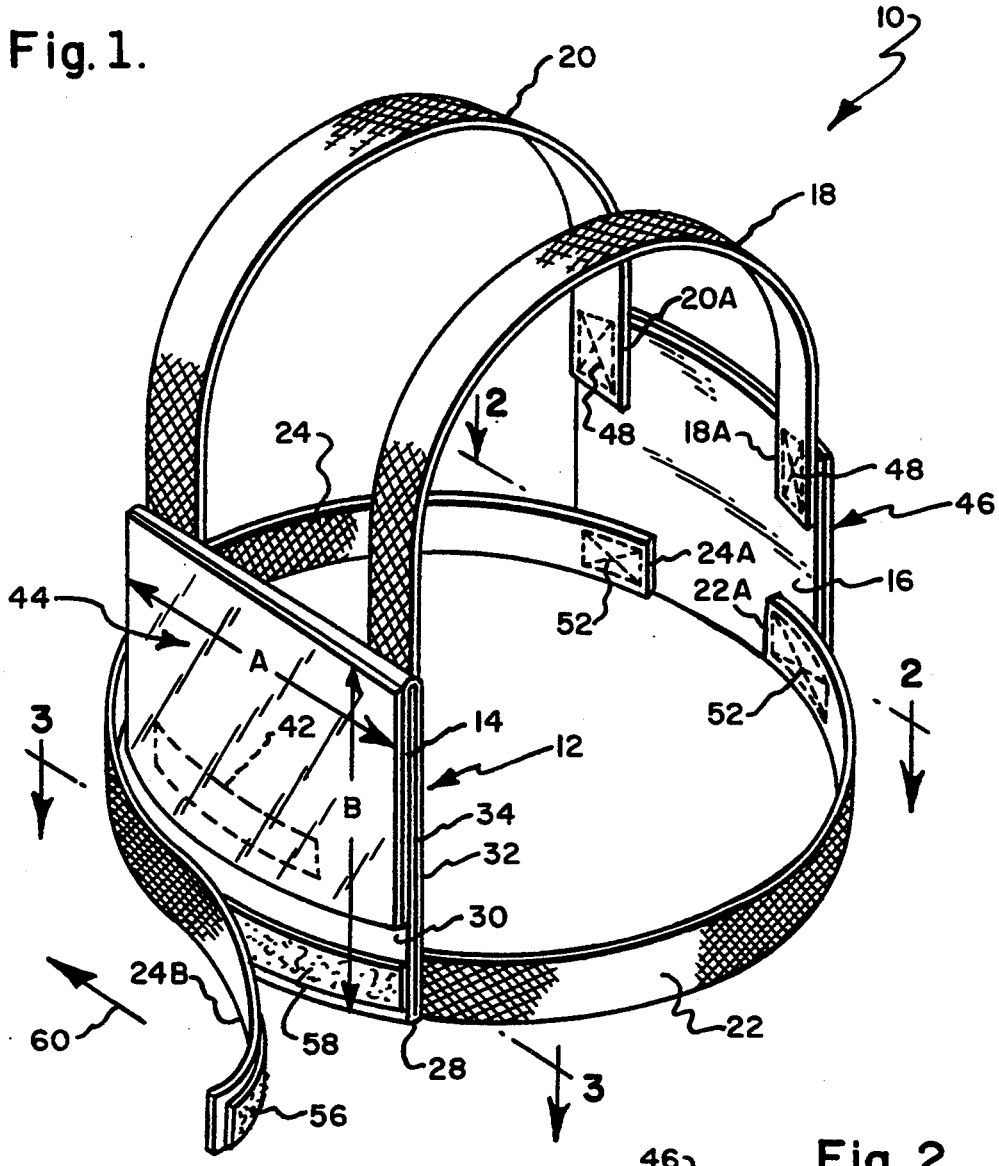
FIG. 1 is a perspective view of the a chest pouch garment 10 of the present invention.
Figure 2:
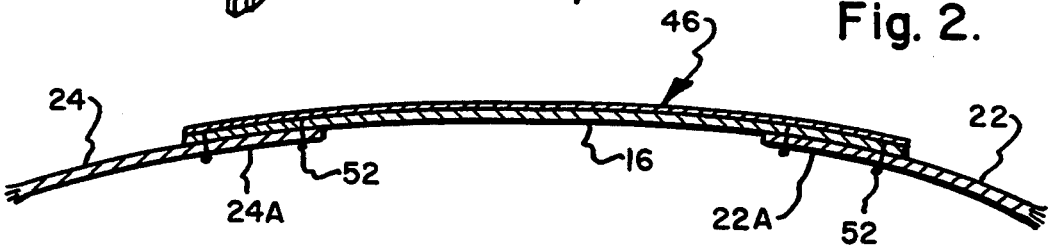
FIG. 2 is a cross-sectional view thereof taken along lines 2—2 of FIG. 1.
Figure 3:
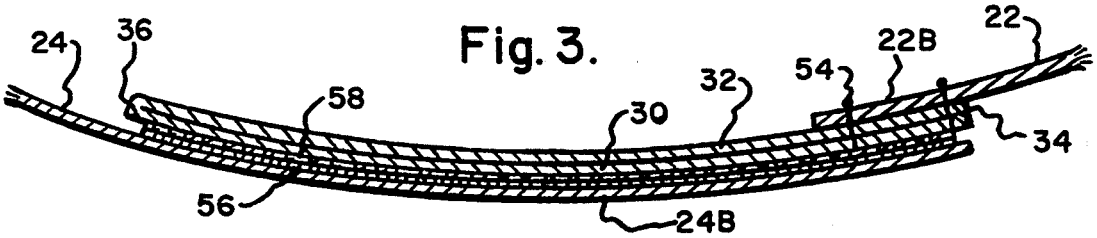
FIG. 3 is a cross-sectional view thereof taken along lines 3—3 of FIG. 1.

Referring to the drawings, FIG. 1 shows a chest pouch garment embodying the present invention, which is broadly denoted by the numeral 10 and comprises a chest pouch 12 having a closable flap 14, a back connecting member 16, a pair of shoulder straps 18 and 20, and a fixed chest strap 22 and an adjustable chest strap 24. Garment 10 is intended to be worn over the torso of a person (not shown) to hold personal effects, such as a Walkman-type radio 26 (FIG. 6), keys, money, jewelry (not shown), and the like. This is particularly beneficial to people engaged in recreational or other activities.

As shown in FIGS. 1, 5, and 6, pouch 12 is made of an integral piece of a washable fabric material, preferably a Nylon material, that has been cut to the required shape and folded along a bottom crease 28 in a doubled-over manner to form a front wall 30 and a back wall 32. The walls 30 and 32 are joined along their adjacent sides 34 and 36 (FIGS. 1 and 4) by sewing or other suitable means to form a flexible envelope having an upper opening 38 leading into the interior 40 of pouch 12 (FIG. 6).

As particularly shown in FIGS. 1, 5, and 6, flap 14 is continuous with back wall 32 and is folded against front wall 30 in an overlapping relationship to close opening 38. Flap 14 is attached to front wall 30 by a first releasable fastener means, which for purposes of illustration comprises a first hook and loop fastener having a first hook and loop VELCRO fastener part 40 that is suitably attached to the outer surface of front wall 30 and a second, mating hook and loop VELCRO fastener part 42 suitably attached to the overlapping inner surface of flap 14 (FIGS. 1 and 4 to 6). That way, flap 14 serves to contain the personal effects, such as radio 26 and the like, inside chest pouch 12 even when the user is engaged in recreational activities such as running, bicycling, and the like. An outer layer of light reflective material 44 is preferably provided on flap 14 as a safety device.

As shown in FIG. 1, back connecting member 16 has a generally rectangular shape made of a washable fabric material, such as Nylon. Connecting member 16 is positionable at a generally central location on the person's back with the back ends 18A and 20A of shoulder straps 18 and 20 fixedly attached to its opposed upper corners by stitching 48. Shoulder straps 18 and 20 extend over the shoulders with their front ends 18B and 20B fixedly attached to chest pouch 12 at the opposed upper corners of the back side of wall 32 adjacent flap 14 by stitching 50. Shoulder straps 18 and 20 are preferably made of a washable elastomeric material having a width of, for example, about 1.0 inch.

As shown in FIG. 1, chest straps 22 and 24 have respective back ends 22A and 24A that are fixedly attached to connecting member 16 at the opposed lower corners thereof by stitching 52, and extend around a left and a right side of the chest to the pouch 12. Connecting member 16 is preferably provided with an outer layer of light reflective material 46 (FIG. 7) that preferably extends over the entire surface of member 16 including the back ends 18A and 20A of shoulder straps 20, and the back ends 22A and 24A of chest straps 22 and 24.

The front end 22B of left chest strap 22 is fixedly attached to the lower, left corner of the back side of wall 32 by stitching 54 while the front portion 24B of right chest strap 24 is releasably attached to the front wall 30 adjacent crease 28 (FIGS. 1 and 3 to 6) by a suitable adjustable means provided by a second releasable fastener means. This comprises a second Velcro fastener having a third hook and loop VELCRO fastener part 56 suitably attached to the inside surface of the front portion 24B of left chest strap 26 and a fourth hook and loop VELCRO fastener part 58 suitably attached to the front side of the front wall 30 of pouch 12. The fourth hook and loop VELCRO fastener part 58 extends substantially the length of front wall 30 to provide for adjusting the length of the third hook and loop VELCRO fastener part 56 attached to the fourth Velcro part 58 to thereby increase or decrease the length of chest strap 24 to provide for positioning chest pouch 12 at a desired location relative to the chest. Chest straps 22 and 24 are preferably made of a similar elastomeric material as that of shoulder straps 18 and 20 and are about 1.0 inch wide. Also, while only chest strap 24 is shown as being releasable from chest pouch 12, it is contemplated by the scope of the present invention that either or both of the chest straps 22 and 24 can be releasably attached to chest pouch 12 by suitable adjustable means.

In use, chest pouch 12 is worn over the torso of a person as a garment 10 to hold personal effects, such as radio 26 (FIG. 6), keys, money, jewelry (not shown), and the like. To don the garment 10, the person holds the front end 24B of right chest strap 24 and pulls in a backwards direction as shown by arrow 60 in FIG. 1 to release third hook and loop VELCRO fastener part 56 from Velcro part 58 on the pouch 12. Pouch 12 is then slipped over the head while the left arm is moved through the opening between left shoulder strap 18 and left chest strap 22. This positions straps 18 and 20 on the shoulders with chest strap 22 mounted around the left side of the chest. Chest pouch 12 is then adjusted to a comfortable position on the chest and right chest strap 24 is moved into contact with pouch 12 to wrap strap 24 around the left side of the chest and connect the third and fourth hook and loop VELCRO fastener parts 56 and 58 to hold pouch 12 in place.

With chest pouch 12 mounted in a comfortable position, flap 14 is moved away from front wall 30 to separate the first and second hook and loop VELCRO fastener parts 40 and 42 and provide entry into the interior 38 of pouch 12. Personal effects, such as radio 26 and the like, can then be placed inside pouch 12 and held therein by moving flap 14 back towards front wall 30 to reconnect the hook and loop VELCRO fastener parts 40 and 42. The person can now engage in recreational activities, including those requiring rigorous exercise such as running, bicycling, and the like, without the personal effects being able to fall out of pouch 12.

As an example of one preferred embodiment of chest pouch garment 10 shown in FIG. 1, the width "A" of pouch 12 is about 7.5 inches and the height "B" is about 6.0 inches with pouch 12 empty. For style purposes, the fabric materials comprising garment 10 can have a variety of colors and can also be provided with decorative indicia (not shown) in addition to reflectors 44 and 46.

It is appreciated that various modifications to the inventive concepts may be apparent to those skilled in the art without departing from the scope and spirit of the invention.

What is claimed is:

1. A chest pouch garment comprising a pouch means, a pair of shoulder straps each composed of an elastic material and having a front end portion and a back end portion, a pair of chest straps each composed of an elastic material and having a front end portion and a back end portion, means for fixedly attaching the back end portions of the shoulder straps and the back end portions of the chest straps to a back member, means for fixedly attaching the front end portions of the shoulder straps and one of the chest straps to the pouch means, first means for releasably attaching the front end portion of the other of the chest straps to the pouch means so that when the front end portion of the other chest strap is released from the pouch means, a length of the other chest strap sufficient to extend between the back member and the pouch means is free to hand from the back member such that the other chest strap does not interfere with inserting a chest and head into the chest pouch garment for donning the garment, and means for adjusting the length of the other chest strap extending between the back member and the pouch means to enable the chest pouch garment to be worn by people having various chest sizes.

2. The garment of claim 1 wherein the first means for releasably attaching the front end portion of the other of the chest straps to the pouch means is a first VELCRO hook and loop fastener.

3. The garment of claim 1 wherein the pouch means is provided with a closure means.

4. The garment of claim 3 wherein the closure means is a flap means that folds over the pouch means to position the flap means in an overlapping relationship with the pouch means.

5. The garment of claim 4 wherein the flap means is held in the overlapping relationship with the pouch means by a second means for releasably attaching the flap means to the pouch means.

6. The garment of claim 1 wherein a light reflective material is provided on an outside surface of the back end portions of the shoulder strap means and the back end portions of the chest strap means.

7. The garment of claim 1 wherein a light reflective material is provided on an outside surface of the pouch means.

8. The garment of claim 1 wherein a light reflective material is provided on an outside surface of the back member.

* * * * *